US006244683B1

(12) United States Patent
Alvarez et al.

(10) Patent No.: US 6,244,683 B1
(45) Date of Patent: Jun. 12, 2001

(54) INK PROTECTION SYSTEM FOR INKJET PRINTERS

(75) Inventors: José A. Alvarez; Christopher Taylor, both of Sant Cugat del Valles (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/253,838

(22) Filed: Feb. 19, 1999

(51) Int. Cl.[7] ..... B41J 2/065
(52) U.S. Cl. ..... 347/22
(58) Field of Search ..... 347/22, 86

(56) References Cited

U.S. PATENT DOCUMENTS 4,901,091 2/1990 Kasamoto .

FOREIGN PATENT DOCUMENTS 57025970 2/1982 (JP) ..... B41J/3/04
57205157 * 12/1982 (JP) .
62068764 3/1987 (JP) ..... B41J/3/10
02078588 3/1990 (JP) ..... B41J/29/00
07017031 1/1995 (JP) ..... B41J/2/01

* cited by examiner

*Primary Examiner*—N. Le
*Assistant Examiner*—Shih-wen Hsieh

(57) ABSTRACT

An ink protection device for an inkjet printhead comprises a flap member associated with the printhead and extending generally parallel to the ink ejection surface of the printhead so that when the printhead is mounted in the carriage the flap member extends between the carriage and a face of the printhead, particularly the electrical interconnect face. The device may be in a two part laminar form attached to the bottom of a carriage of the printer and having a flexible part for contacting all four faces of the printheads and a stiff part for support. Both parts having openings aligned with the openings in the carriage through which the printhead snout passes.

23 Claims, 8 Drawing Sheets

FIG. 3
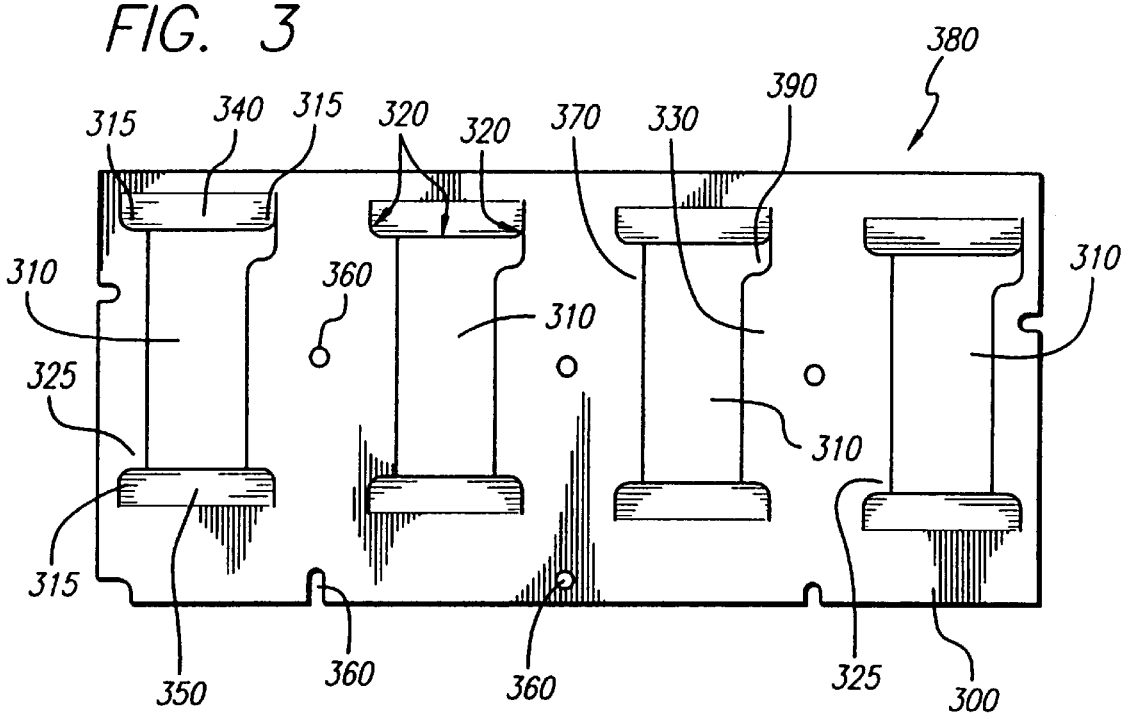
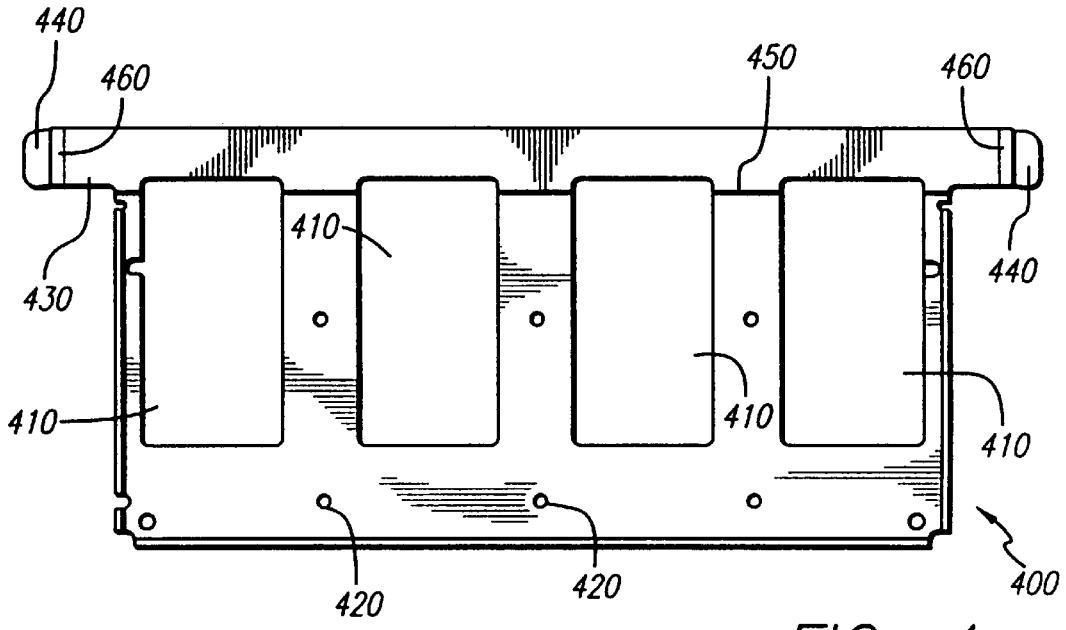
FIG. 4

FIG. 6
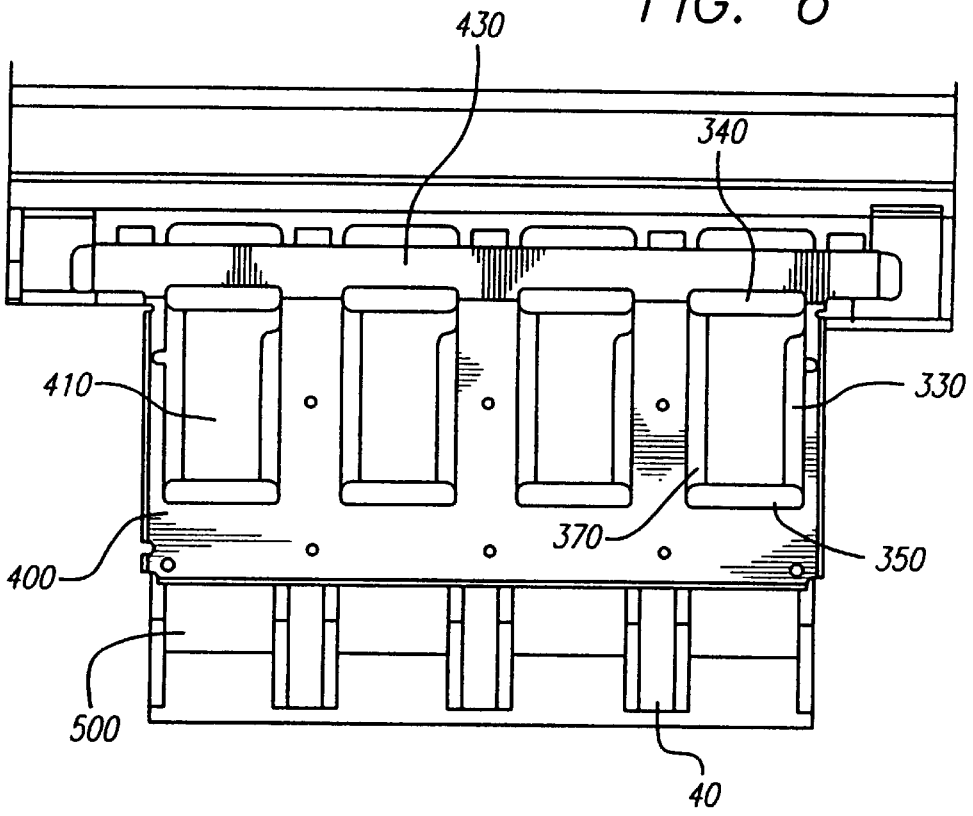
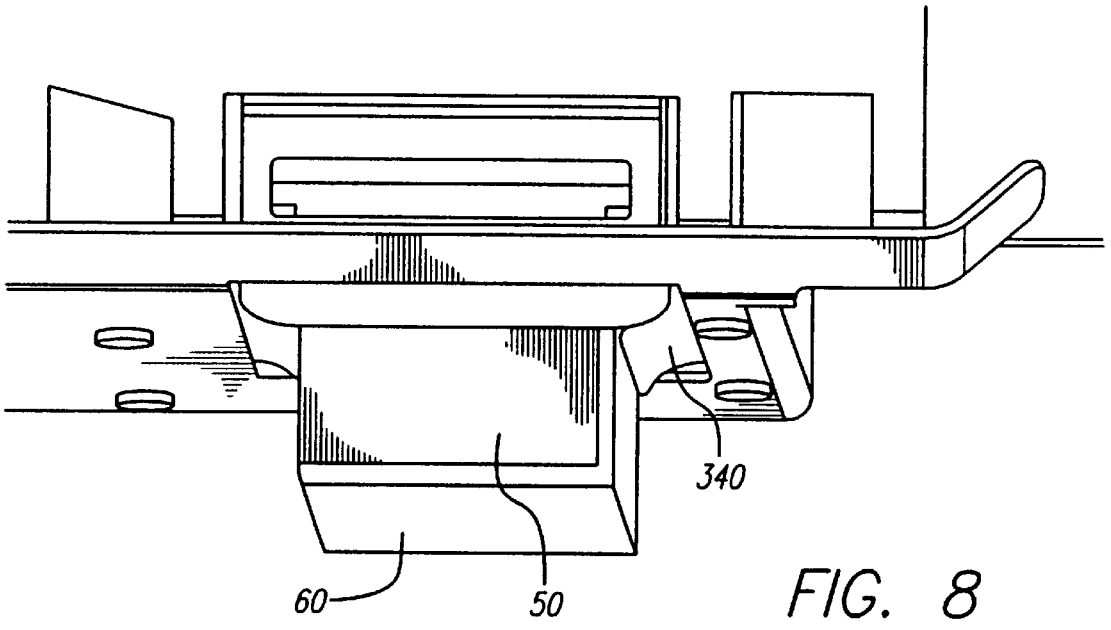
FIG. 8

FIG. 7
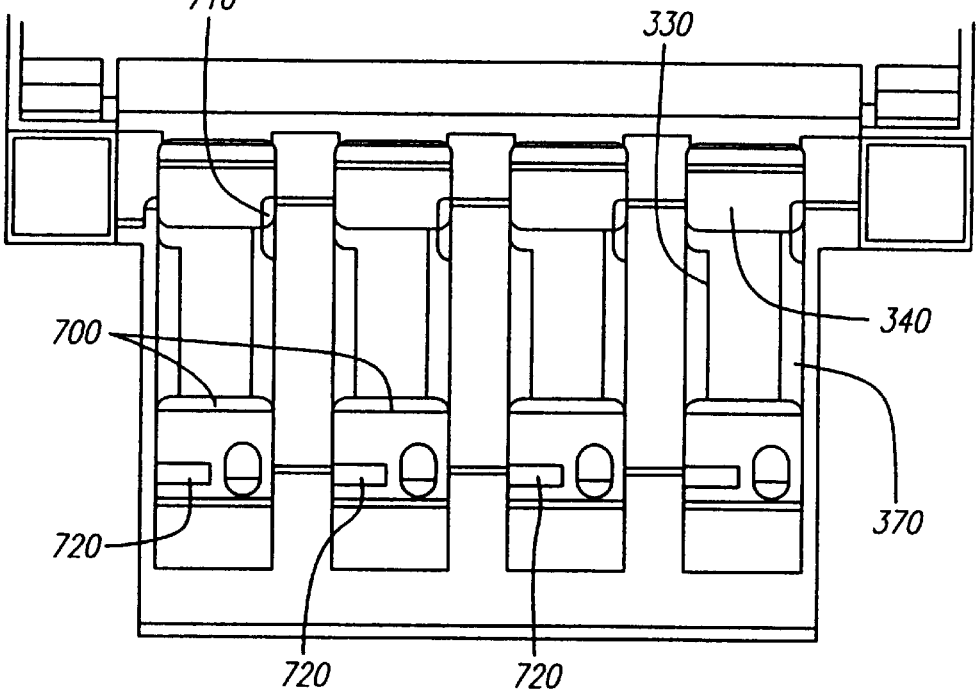
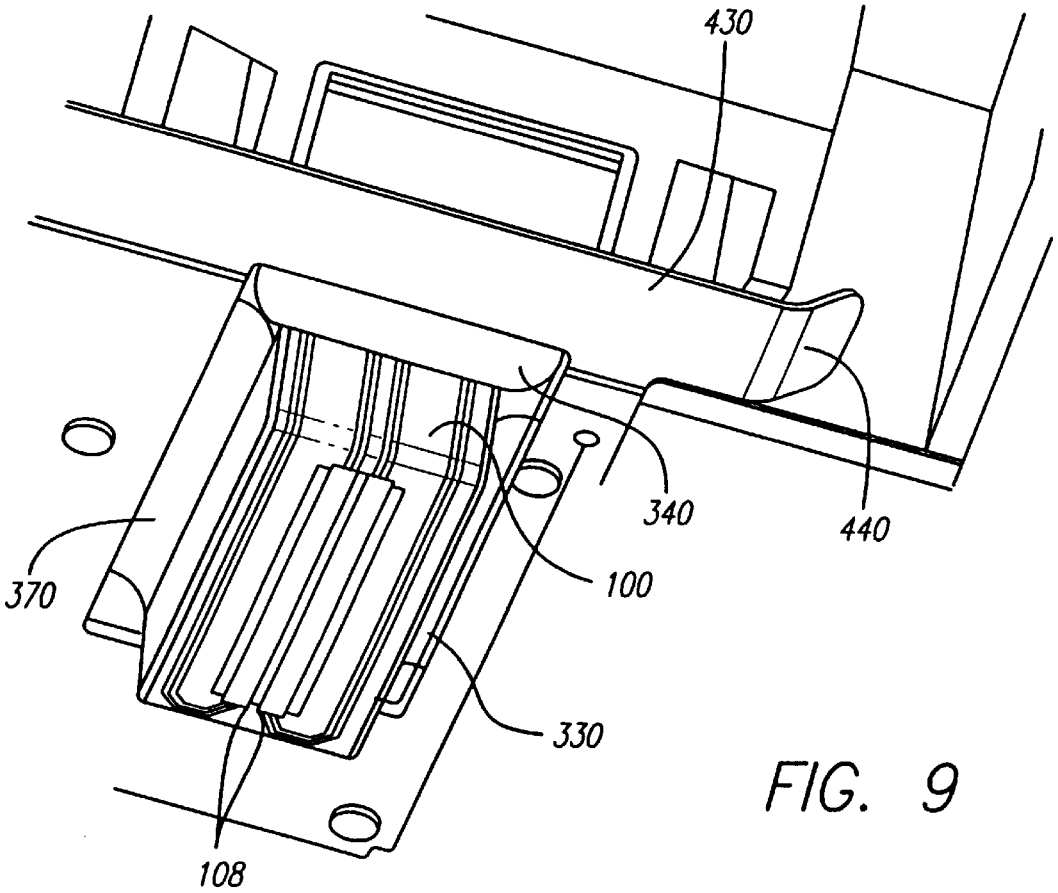
FIG. 9

FIG. 10A
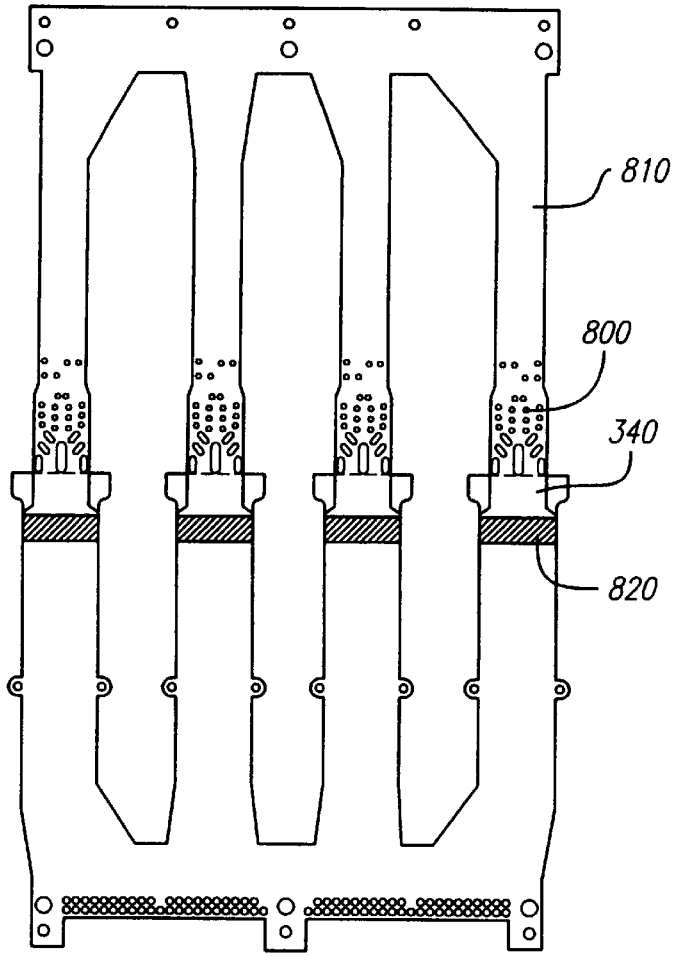
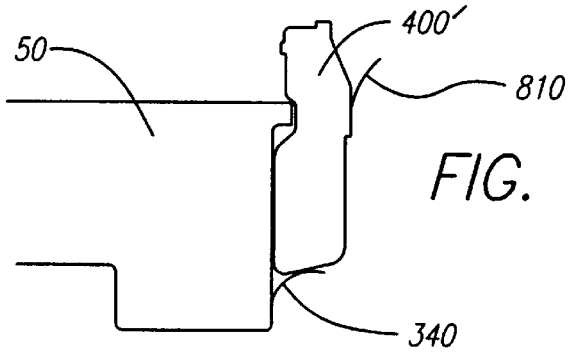
FIG. 10B
FIG. 11
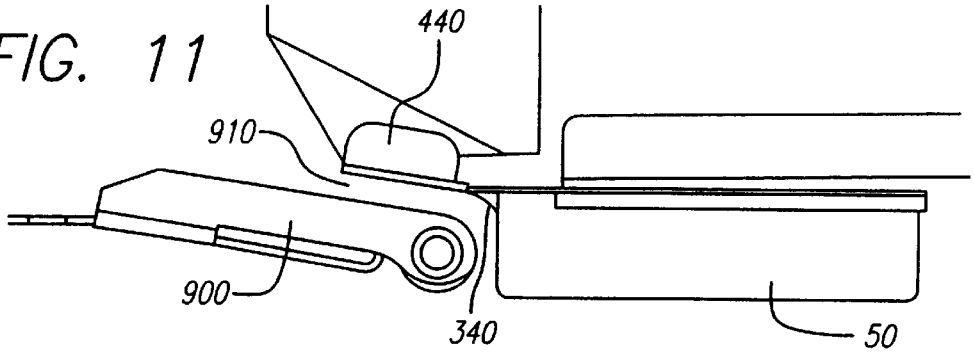

INK PROTECTION SYSTEM FOR INKJET PRINTERS

The present invention relates to an ink protection device for an inkjet printhead, and in particular to a protection device which protects the electrical interconnect of a printhead from ink.

The present invention relates to the art of inkjet printing mechanisms whether of the thermal or piezo variety which may be included in a variety of different products including copiers and facsimile machines in addition to standalone printers either desktop mounted, portable or freestanding. Herein a freestanding printer will be used to illustrate the present invention. Printers of this type have a printhead carriage which is mounted for reciprocal movement on the printer in a direction orthogonal to the direction of movement of the paper or other medium on which printing is to take place through the printer. The printer carriage of a color printer typically has two or more, usually four, thermal ink Jet printheads mounted thereon which may be removable. Each of the printheads contains or is attached to a remote supply of ink which is fed via ink channels within the printhead to an ink ejection mechanism generally in the lower part of the printhead and ejected as drops through a nozzle plate mounted on an ink ejection surface of the printhead. The nozzle plate having numerous small orifices or nozzles therethrough. For thermal (as opposed to piezoelectric) inkjet printheads ink channels or conduits lead to firing chambers each associated with heater elements, Such as resistors, which are energized to heat ink within the firing chambers. Upon heating, an ink drop is ejected from a nozzle associated with the energized resistor.

To service, that is clean, maintain, protect or recover the correct operation of the printhead, typically a "service station" mechanism is mounted within the printer so the printhead can be moved over to the station for servicing. For storage, or during non-printing periods, the service stations usually include a capping system which hermetically seals the printhead nozzles from contaminants and prevents drying. Some caps are also designed to facilitate priming, such as by being connected to a pumping unit or other mechanism that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, priming or occasionally during printing, most service stations have an elastomeric wiper that wipes the ink ejection surface of the printhead to remove ink residue, as well as any paper dust or other debris that has collected on the face of the printhead.

During printing and spitting, some small ink droplets may become airborne within the printer, forming what is known as "ink aerosol". Unfortunately, this ink aerosol often lands in undesirable locations on the inkjet printhead that are not normally cleaned by the printhead service station. For example, this ink aerosol may collect along a portion of the printhead exterior next to the electrical interconnect that sends the firing signals to the printhead. Moreover, the process of wiping the printhead often deposits ink on this portion of the printhead adjacent the electrical interconnect. Beyond leaving the printhead dirty with ink residue, unfortunately, many inkjet inks are also electrically conductive, so any ink smeared on the conductors of the electrical interconnect has the potential for causing a short circuit between the conductors. Ink residue deposited on the printhead next to the electrical interconnect may be smeared on the interconnect conductors when the printhead is removed, and then further smeared across the interconnect when a new printhead is installed increasing the chances for a short circuit to occur. Furthermore such ink may cause corrosion of the electrical contact pads of either the carriage or the printhead. A prior art solution to ink residue adjacent the electrical interconnect comprises the use of a so called "snout wiper" which is a wiper similar to those conventionally used to wipe the ink ejection surface of the printhead, to wipe an area of the vertical interconnect face of the printhead below the electrical interconnect pads. However. in addition to imposing further complication on the service station of the printer and its associated servicing routines it has been found that such snout wiping is insufficient to remove all such ink residue. Furthermore any ink residue that remains has been found to migrate upwards towards the electrical interconnect pads of the printhead through capillary forces.

A further problem due to ink residue (and which is not resolved by snout wiping) is that it has been found that ink aerosol can build up within the stalls of the printer carriage in which the printheads are located and can make its way between the datum surfaces on the printhead and the carriage which serve to accurately align the printhead within the carriage. This can lead to printing errors in images printed due to misplacement of ink droplets fired by the printhead on print media.

A further factor in the buildup of ink residue on inkjet printheads is that the lifetimes required of the printheads is increasing, particularly for printheads that are utilised in combination with large volume ink reservoirs which are remote from the printhead (so called "off-axis" systems) and which may be replaced without replacing the printhead. The ink residue problem is exacerbated in an off-axis system because the printheads are replaced less frequently during the useful life of the printer so this residue may build-up over a longer period in contrast to a replaceable printhead system, which requires replacement of the printhead when empty.

According to the present invention there is provided an ink protection device for an inkjet printhead mountable within a carriage of a printer the printhead having an ink ejection surface through which ink is ejected and a plurality of faces extending from the ink ejection surface, the device comprising a flap member associated with the printhead and extending generally parallel to the ink ejection surface so that when the printhead is mounted in the carriage the flap member extends between the carriage and a face of the printhead. It has been found by the present Applicants that a simple physical barrier to the passage of ink which acts on the printhead when it is mounted in the carriage is effective in greatly reducing the level of ink passing into the carriage past the printhead either in the form of aerosol or liquid in contact with a face of the printhead.

Although the flap member may be mounted on the printhead, preferably, the flap member is mounted on the carriage and contacts a face of the printhead.

Advantageously, the flap member is composed of a material which is both compliant and resilient so that it is able to repeatedly contact the printhead and form a substantially ink tight seal.

Preferably, the flap member is generally parallel to the ink ejection surface of the printhead prior to the insertion of the printhead into the carriage, more preferably the flap member extends at an angle of less than 30 degrees to the plane of the ejection surface of the printhead, most preferably at an angle of less than 15 degrees.

However, it is advantageous that the printhead deflects the flap member when it is installed so that the flap member curves downwardly, preferably at an angle of less than 45 degrees.

In a specific embodiment, the ink protection device comprises four flap members per printhead, one associated with each face of the printhead. This has been found to be very effective at impeding the entry of ink aerosol in the carriage and thus preventing ink residue on the datum surfaces of the printhead and carriage.

Conveniently, the device comprises a first substantially laminar component formed of a flexible material and a second substantially laminar component formed of stiffer material, the first component comprising a plurality of openings each having at least one flap member and the second component comprising a plurality of openings located to be in alignment with the openings in the first component and wherein both components are adapted to be mounted to a surface of the carriage of the printer which is close to a print zone of the printer so that the first component is supported by the second component. This design avoids the need to make any changes to the printer carriage since the device can simply be attached to the bottom of the carriage. As printer carriages are complex and serve may functions this is a particularly advantageous and low cost method of achieving the benefits of the present invention.

Preferably, the openings in the second components are larger than the openings in the first component and wherein the relative size of the openings is determined dependent on the flexibility of the first component and the desired contact force between the at least one flap member of the first component and a printhead. The correct contact force between the flap member and the printhead is important since if the force is too low, ink may leak past the flap member and if the force is too high, the flap member may prevent the correct positioning of the printhead within the carriage.

Advantageously, the second component comprises a baffle member, for protecting components of the carriage from mechanical damage, located proximate to an interconnect flap member of said first component. This has been found to be useful for purposes other than ink protection, namely for the protection of delicate components of the carriage particularly the electrical interconnect from damage from other components of the printer such as parts of the media handling mechanisms, particularly in the event of a "paper crash" (wherein a protruding portion of a print media interfers with the motion of the carriage.

This function is aided if the baffle member the baffle member extends away from the second component of the device at an angle to the plane of the second component and further improved if it comprises, at its extreme ends in the scanning axis direction, a deflector angled further away from the plane of the second component of the device. This deflector is able to act as a ski tip and help the carnage to avoid paper crashes.

As an alternatively to this two part construction of the ink protection device, the device may simply comprise a flap member mounted on an electrical connection member of the carriage. This embodiment is preferred when only a single flap member in contact with the interconnect face of each printhead is desired.

Further advantages and objects of the present invention will be appreciated from specific embodiments of the present invention which will now be described by way of example only and with reference to the following drawings in which:

FIG. 1 shows an inkjet printing mechanism in which embodiments of the present invention may be implemented, FIG. 2 shows a printhead and various aspect of its insertion into a carriage, FIG. 3 shows a carriage dam according to an embodiment of the present invention, FIG. 4 shows a carriage protector according to a first embodiment of the present invention, FIG. 5 is an exploded perspective view of the carriage dam and protector and a carriage, FIG. 6 is a view from below of a carriage on which a carriage dam and protector are mounted, FIG. 7 is a view of the carriage of FIG. 6 from above, FIG. 8 is a perspective view from the direction of the printer and slightly below showing a printhead located in the carriage and engaged by the carriage dam, FIG. 9 is magnified view from a position slightly below that of FIG. 8, FIG. 10A shows a flex circuit having a flap member according to a second embodiment of the present invention, FIG. 10B shows the flex circuit of FIG. 10A in a carriage.

FIG. 11 is a side view showing a pinch wheel assembly of a printer and the baffle and deflector of the first embodiment of the invention, FIG. 12 is a perspective three quarter view of the pinch wheel arrangement of FIG. 11 in the printer.

FIG. 1 illustrates an inkjet printing mechanism, here shown as an inkjet printer 20, in which embodiments of the present invention may be implemented. A variety of inkjet printing mechanisms are commercially available. For instance, some of the printing mechanisms that may embody the present invention include desk top printers, portable printing units, copiers, cameras, video printers, and facsimile machines. For convenience the concepts of the present invention are illustrated in the environment of an inkjet printer 20.

The inkjet printer 20 includes a chassis 22 surrounded by a housing or casing enclosure 24, typically of a plastic material, together forming a print assembly portion 26 of the printer 20. While it is apparent that the print assembly portion 26 may be supported by a desk or tabletop, it is preferred to support the print assembly portion 26 with a pair of leg assemblies 28. The printer 20 also has a printer controller, illustrated schematically as a microprocessor 30, that receives instructions from a host device, typically a computer, such as a personal computer or a computer aided drafting (CAD) computer system (not shown).

The printer controller 30 may also operate in response to user inputs provided through a key pad and status display portion 32, located on the exterior of the casing 24.

A conventional print media handling system (not shown) may be used to advance a continuous sheet of print media 34 from a roll through a printzone 35. The print media may be any type of suitable sheet material, such as paper, poster board, fabric, transparencies, mylar, and the like, but for convenience, the illustrated embodiment is described using paper as the print medium. A carriage guide rod 36 is mounted to the chassis 22 to define a scanning axis 38, with the guide rod 36 slideably supporting an inkjet carriage 40 for travel back and forth, reciprocally, across the printzone 35. A conventional carriage drive motor (not shown) may be used to propel the carriage 40 in response to a control signal received from the controller 30. To provide carriage positional feedback information to controller 33, a conventional metallic encoder strip (not shown) may be extended along the length of the printzone 35 and over the servicing region 42. A conventional optical encoder reader may be mounted on the back surface of printhead carriage 40 to read positional information provided by the encoder strip. Upon completion of printing an image, the carriage 40 may be used to drag a cutting mechanism across the final trailing portion of the media to sever the image from the remainder of the roll 34. Moreover, the illustrated inkjet printing mechanism may also be used for printing images on pre-cut sheets, rather than on media supplied in a roll 34.

In the printzone 35, the media sheet receives 1Xink from an inkjet printhead, such as a black ink printhead 50 and three monochrome color ink printheads 52, 54 and 56. The black ink printhead 50 is illustrated herein as containing a pigment-based ink. For the purposes of illustration, color printheads 52, 54 and 56 are described as each containing a dye-based ink of the colors yellow, magenta and cyan, respectively, although it is apparent that the color printheads 52–56 may also contain pigment-based inks in some implementations. It is apparent that other types of inks may also be used in the printheads 50–56, such as paraffin-based inks, as well as hybrid or composite inks having both dye and pigment characteristics. The illustrated printer 20 uses an "off-axis" ink delivery system, having main stationary reservoirs (not shown) for each ink (black, cyan, magenta, yellow) located in an ink supply region 58. In this off-axis system, the printheads 50–56 may be replenished by ink conveyed through a conventional flexible tubing system (not shown) from the stationary main reservoirs, so only a small ink supply is propelled by carriage 40 across the printzone 35 which is located "off-axis" from the path of printhead travel. As used herein, the term "printhead" may also refer to replaceable printheads where each printhead has a reservoir that carries the entire ink supply as the printhead reciprocates over the printzone.

The illustrated printheads 50, 52, 54 and 56 have ink ejection surfaces having nozzle plates 60, 62, 64 and 66, respectively, which selectively eject ink to from an image on a sheet of media 34 in the printzone 35. These inkjet printheads 60–66 have a large print swath, for instance about 20 to 25 millimeters (about one inch) wide or wider, although the ink protection concepts described herein may also be applied to smaller inkjet printheads. The concepts disclosed herein for protecting the printheads 60–66 and carriage 40 apply equally to the totally replaceable inkjet pintheads, as well as to the illustrated off-axis semi-permanent or permanent printheads, although the greatest benefits of the illustrated system may be realized in an off-axis system where extended printhead life is particularly desirable.

The printheads 60, 62, 64 and 66 each have an nozzle plate with a plurality of nozzles formed therethrough in a manner well known to those skilled in the art. The nozzles of each printhead 60–66 are typically formed in at least one, but typically two linear arrays along the nozzle plate. Each linear array is typically aligned in a longitudinal direction perpendicular to the scanning axis 38, with the length of each array determining the maximum image swath for a single pass of the printhead. The illustrated printheads 60–66 are thermal inkjet printheads, although other types of printheads may be used, such as piezoelectric printheads. The thermal printheads 60–66 typically include a plurality of resistors which are associated with the nozzles. Upon energizing a selected resistor, a bubble of gas is formed which ejects a droplet of ink from the nozzle and onto a sheet of paper in the printzone 35 under the nozzle. The printhead resistors are selectively energized in response to firing command control signals delivered from the controller 30 to the printhead carriage 40.

FIG. 2 illustrates several details of the manner in which the printheads 50–56 are installed within the carriage 40. For the purposes of illustration, the black printhead 50 is shown, and the concepts illustrated herein are typical to printheads 52, 54 and 56. The printhead 50 includes an electrical interconnect 100 located along a rearward facing portion of the cartridge. The electrical interconnect 100 comprises a flexible strip which has a series of conductive contact pads located to be in electrical contact with a series of matching contact pads on a flex strip 102 mounted along an interior portion of the carriage 40. To provide a solid physical contact between the pads of the printhead flex strip 100 and the carriage flex strip 102, preferably the carriage flex 102 is mounted above a pusher member 104, which is biased by a spring 105 to push the carriage flex strip 102 into contact with the printhead flex 100, as illustrated by arrow 106 in FIG. 2.

The printhead flex 100 carries the electrical signals received from the carriage flex 102 to the firing resistors which heat the ink to eject droplets from nozzles 108 of printhead 50.

To allow the printhead 50 to receive black ink from the main storage reservoir 60 in the illustrated off-axis printer 20, the printhead 50 has a straight, hollow inlet needle 100, located along a forward portion of the printhead 50. The needle 110 is guarded by a shroud 112 to prevent an operator's fingers from inadvertently coming in contact with the needle. The carriage 40 also supports an inlet valve 114, which has an elastomeric septum 15 defining, a performed slit 16 therethrough. The valve 114 also has a flanged inlet port 118, to which a black ink tube 58' is coupled to receive black ink from the main reservoir 60. The black ink tube 58' is part of the tube assembly of the printer 20 in FIG. 1 that delivers ink from each of the main reservoirs 58 to the respective printheads 50–56.

As mentioned above, during printing some of the ink droplets ejected from the nozzles 108 never reach the print media, or a spittoon portion (not shown) of the service station 80 during a spitting cycle, but instead these droplets become floating ink aerosol satellites. This ink aerosol floats until it eventually lands, often on one of the printer components. One exposed region of the printhead 50 which is not cleaned by the conventional, service station black printhead wiper, is shown in FIG.2, where ink residue 120 has accumulated and collected along a lower nose or snout portion 122 of the printhead flex strip 100.

Moreover, the act of wiping the printhead 50 with a conventional wiper may also deposits ink on this nose portion 122 in two different ways. The first type of deposit, known as "flicked ink", occurs when wiping the printhead 50 by moving the wiper toward the rear of the printer 20, that is, to the right or negative Y direction in FIG. 2. After the end tip of flexed conventional wiper clears the edge of the printhead 50, the elastomeric nature of the wiper tries to return to an upright rest position, but instead over-compensates, first by flexing to the far right, then unfortunately by swinging back to the left, eventually dampening out to an upright rest position. During the return-stroke portion of this dampening travel, the wiper flicks ink residue back on the interconnect nose 122. The second type of wiper deposit, known as "wiper scrape", occurs when wiping the printhead 50 in the opposite direction toward the front of printer 20, that is, to the left or positive Y direction in FIG. 2 Here, the conventional wiper actually contacts the nose 122 because there is a mandatory interference fit between the wiper and the printhead face, which is required to flex the wiper into wiping contact with the printhead. Thus, the wiper scrapes any ink residue on the front surface of the blade directly onto the nose 122.

While it is know to utilise additional specialised snout wipers to wipe the nose 122 or snout which operate generally at a right angle to the direction of operation of conventional nozzle plate wipers, in an attempt to remove the ink residue 120, it has been found these have disadvantages. Firstly, they require a different operation of the service station of a printer from that required for conventional wiping since they require a different wiping motion. Secondly, if cross contaminant between different printheads is to be avoided, one snout wiper per printhead must be provided in addition to the conventional nozzle wipers and other service components. Thirdly, such snout wipers have been found to not be completely effective in preventing remaining ink residue from migrating up the interconnect 100 of printheads by capillary action to reach the electrical connection pads of the printhead or carriage. Fourthly, snout wipers are completely ineffective in preventing ingress of aerosol between the carriage 40 and the printhead 50.

Although embodiments of the present invention are useful and advantageous when employed with all types of inkjet printhead and carriages, a particular printhead installation process will now be described (which is required due the ink delivery system employed) which worsens the above described problem of ink residue forming on the snout and being passed to the interconnect.

The inlet needle 110 on the printhead 50 is rigidly mounted within the shroud to pierce the septum 115 along slit 116 during printhead installation. The shroud 112 is sized to surround the valve 114. While the valve 114 is preferably constructed to tilt slightly with respect to the carriage 40, it is apparent from this construction that insertion of needle 110 into septum 15, as well as removal therefrom, must use a substantially linear motion as indicated by arrow 123 in FIG. 2. Thus, if printhead installation/removal for the inlet valve 114 at the front of the cartridge must be in a substantially vertical direction 123, then installation/removal at the rear of the cartridge where the electrical interconnect is located must also be vertical, as illustrated by arrow 124 in FIG. 2.

Unfortunately, the inks used in inkjet printers often have an electrically conductive nature, so ink residue smeared between contact pads of the carriage interconnect 102 may form an electrical bridge between those contact pads, causing them to short out. Then when a fresh printhead is installed vertically, the spring 105 again pushes the carriage interconnect 102 into contact with the interconnect 100 of the fresh cartridge, smearing this ink residue across both interconnects 100 and 102. With this smeared ink now smeared randomly between the contact pads, there exists a likelihood that two or more the contact pads of interconnects 100, 102 may become shorted out, causing nozzles to either not fire or to misfire, either occasion of which severely degrades print quality. Worse yet, this short circuit condition may permanently damage the printhead, the printer 20, or both.

As shown in FIG. 2, the printhead 50 has a number of alignment datums 134, 160, 170. These printhead alignment datums mate against matching carriage alignment datums to align the printhead with the carriage in the X, Y and Z directions, as well as with respect to the 0x, 0y and 0z rotational degrees of freedom about these axes, to ensure accurate dot placement on the media.

A further problem caused by ink aerosol rather than by the build tip of ink residue on the snout of a printhead is that it has been found that ink aerosol can build up within the stalls of the printer carriage in which the printheads are located and can make its way between the datum surfaces on the printhead and the carriage which serve to accurately align the printhead within the carriage. This can lead to printing errors in images printed due to misplacement of ink droplets fired by the printhead on print media.

Referring now to FIGS. 3, 4 and 5, which show a carriage dam 380 and a carriage protector 400. The dam 380 is formed from a single sheet of polyester of 0.125 mm thickness having a tensile strength of 190 Kg/cm2 longitudinally and 120 Kg/cm2 transversely. Within the sheet four openings 310 have been punched in a conventional manner. Lines 320 show where the sheet has been cut, thus it can be seen that each opening 310 is surrounded by four flaps 340, 350, 370, 330

FIG. 5 is an exploded protective view showing the assembly of the dam 380 and of the material of the sheet which are attached to the sheet at one of their sides and free to move at the other of their sides. The size of the openings 310 measuring from the free sides of the flaps is 13.1 mm by 31.5 mm. The dam 380 also has holes 360 cut through it to facilitate mounting on the carriage 40.

It will be noted that the two end flaps 340, 350 have been cut to include more material of the sheet at their ends 315 than is included in the ends 325 of the side flaps 330, 370. Thus the end flaps 340, 350 extend to their greatest allowed width. These two end flaps will engage the end faces 150, 180 of the printhead. Flap 340 engaging the interconnect face 150 of the printhead and flap 350 engaging the opposite end face 180 of the printhead. The side flaps 330, 370 will engage the side faces 190, 195 of the printhead. Finally it should be noted that the side flap 330 at its end 390 has been cut so as to avoid contact with the side face 190 of the printhead.

With reference to FIG. 4, a carriage protector 400 is formed from a single sheet of stainless steel of thickness 0.5 mm and has four openings 410 punched through it of size 21 mm by 40 mm. The centres of the openings 410 are spaced at the same separation as the centres of the openings 310 in the dam 380. At one side of the protector 400 is a baffle 430 running the length of the protector and having a deflector 440 at each of its ends. The baffle 430 is bent away from the plane of the protector 400 along the line 450 and the deflectors 440 are bent further away from the plane of the protector along the lines 460. The protector 400 has holes 420 cut through it which have the same separation as the holes 360 in the dam 380. protector 400 onto the carriage 40. Carriage 40 has a number of plastic molded studs 510 which protrude from its lower surface 520. The dam 380 is first aligned with the bottom 520 of the carriage 40 and mounted so that the studs 510 protrude through the holes 360 in the dam. Then protector 400 is place on top of dam 380 so that the studs 510 also protrude through the holes 420 in the protector. Heat and pressure is then applied to the studs 510 so that they deform against the surface of the protector 400 to firmly hold both the protector and the dam 380 on the bottom of the carriage. It will be appreciate that other attachment means such as screws or glue may be employed.

FIG. 6 is a view from below of the bottom 520 of the carriage 40 looking upwards and shows the dam and protector in place and the protrusion of the flaps 330, 370, 340, 350 past the edges of the openings 410 in the protector. Also it can be seen that the openings 310 in the dam 380 are aligned with stalls 500 in the carriage. FIG. 7 is a view of the same assembly as FIG. 6 taken from above and additionally carriage datum 700, 710, 720 can be seen which interact with printhead datums shown in FIG. 2.

FIG. 8 is perspective view from below and to the side showing one printhead 50 mounted in the carriage and engaged with the flaps of the dam.

FIG. 9 is a magnified view of FIG. 8 also showing the nozzles 108 and interconnect 100 of the printhead.

Figure 1:
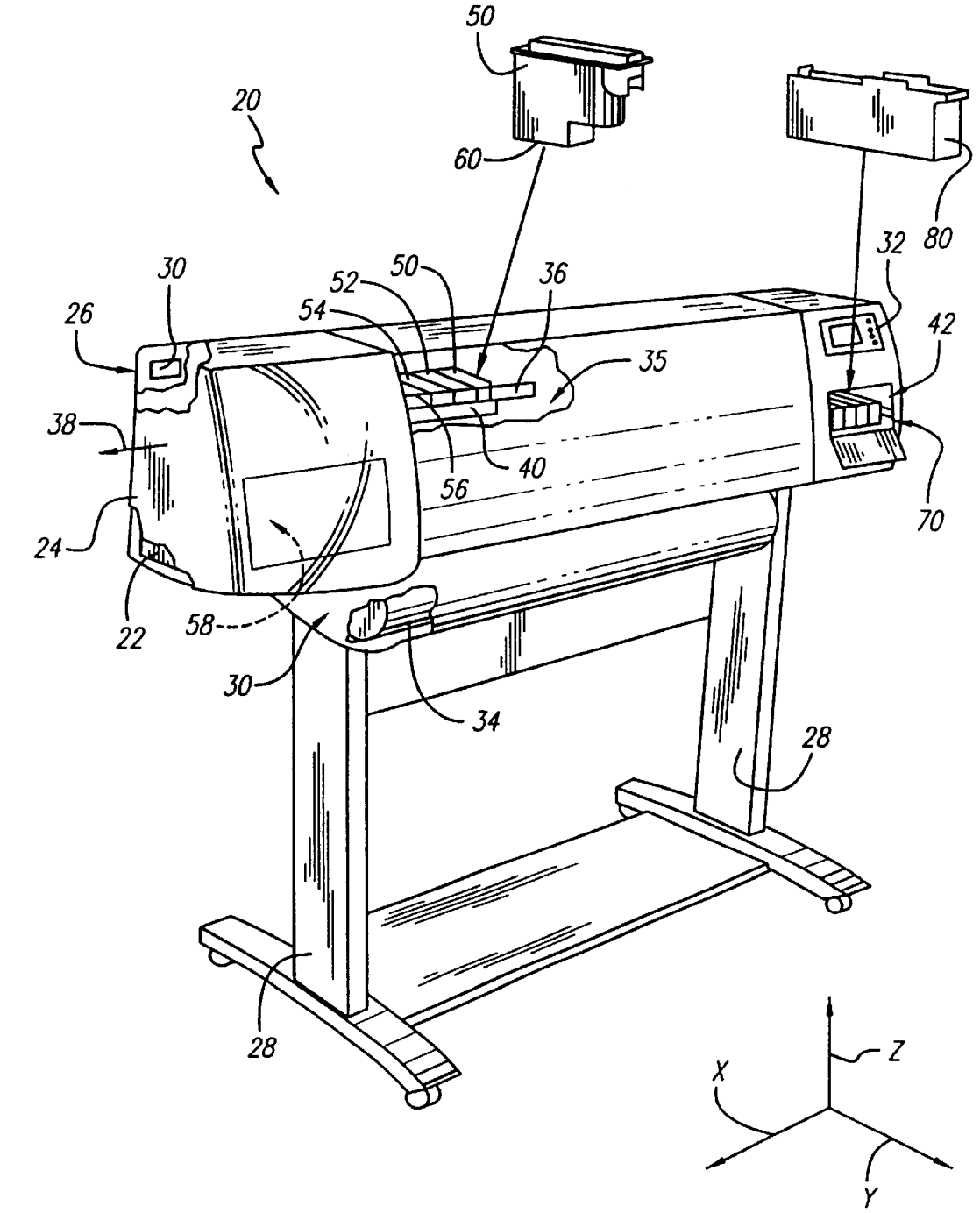
Figure 2:
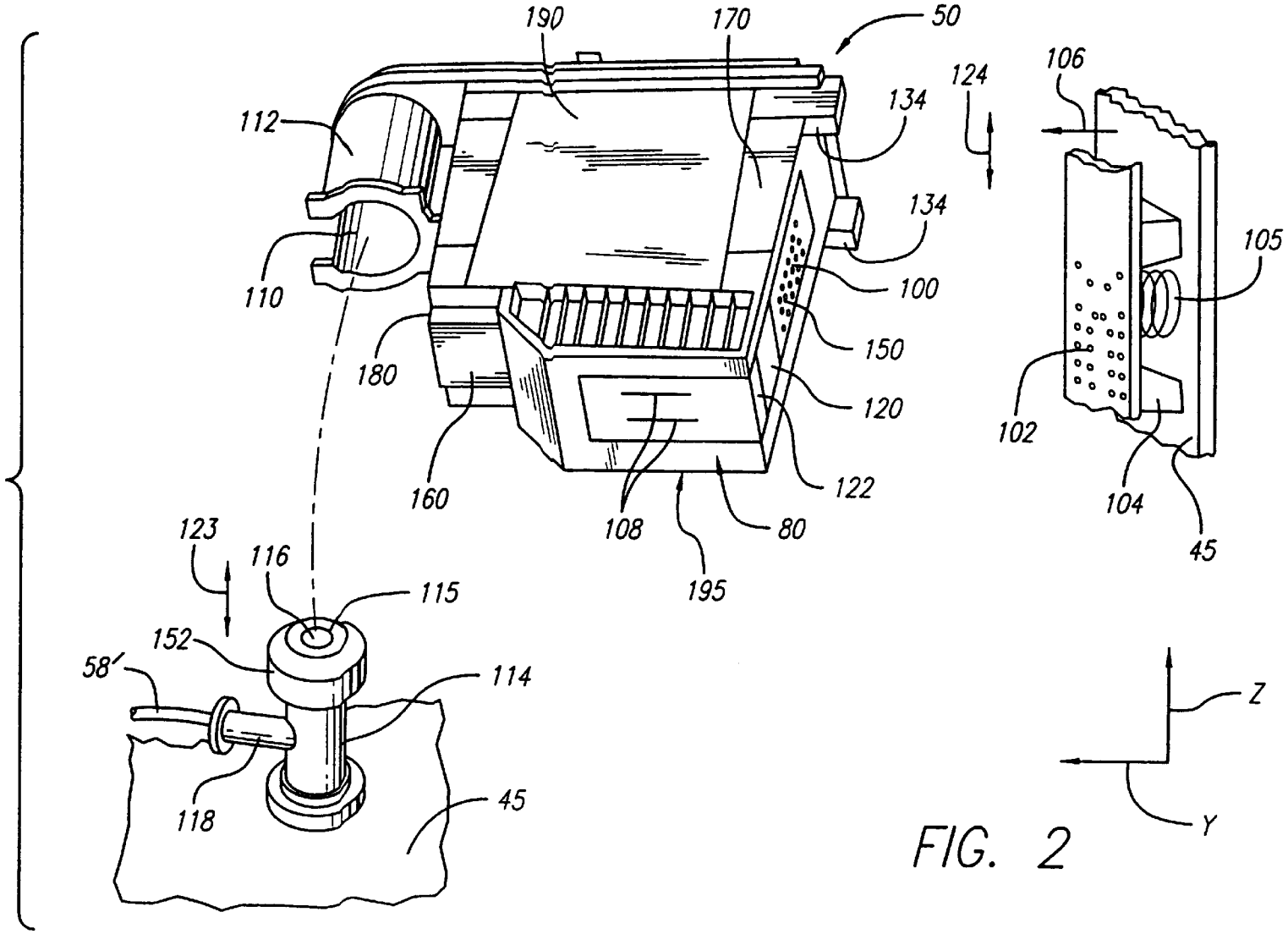
Figure 5:
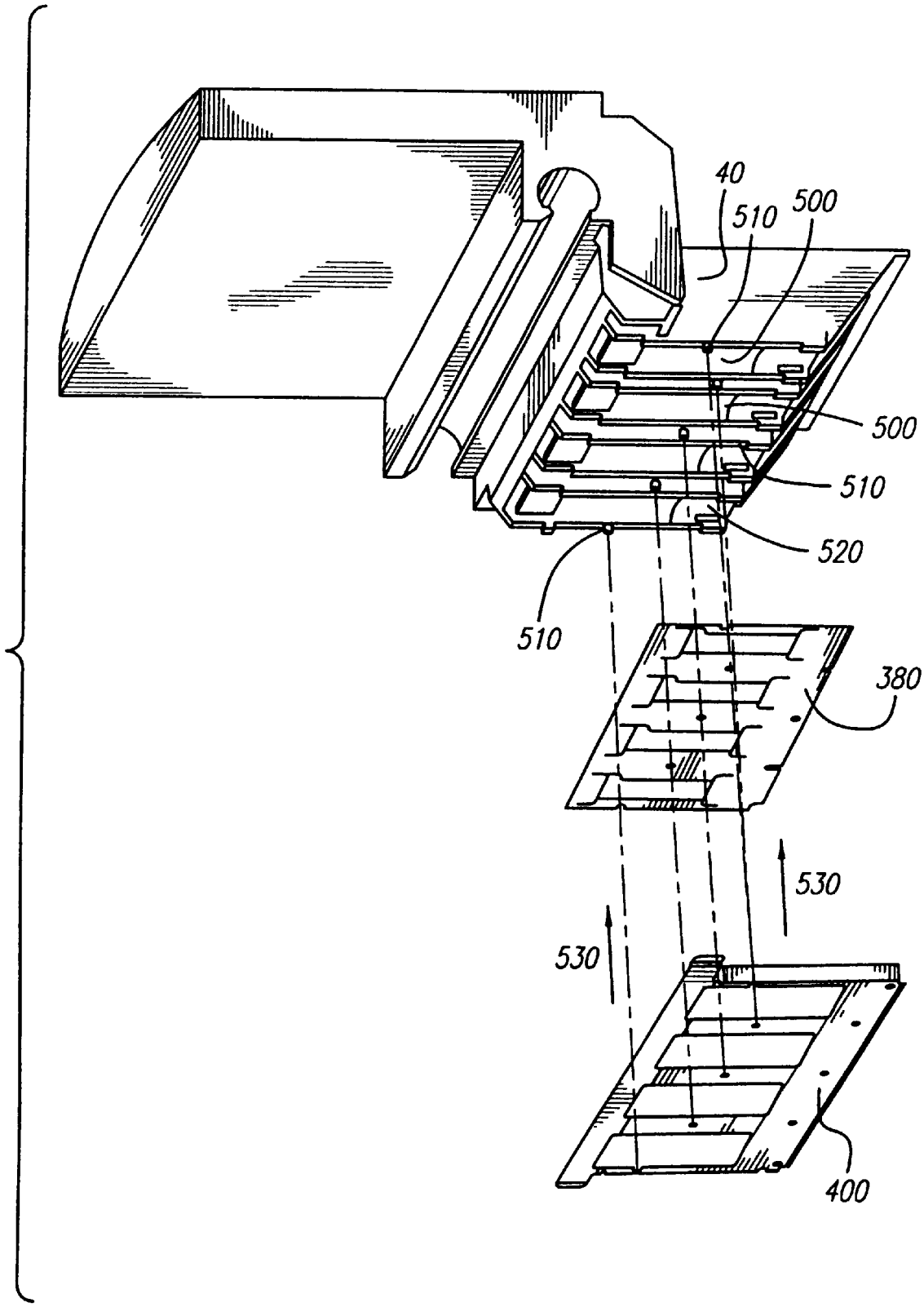

From the above description and figures it can be seen that when a printhead is mounted within the carriage of a printer provided with a dam and protector the flaps of the dam engage the printhead and in some cases flex against it. The flaps effectively cover the gap between the printhead and the carriage on all sides of the printhead and thus prevent aerosol from entering the carriage from the printzone. Also the flap 340 prevents any ink on the printhead snout from progressing up the interconnect 100 towards the electrical pads (not shown).

It will be appreciated that the relative sizes of the openings in the dam and the protector and the size of the snout of the printhead are important to achieve the right level of interference between the printhead and the flaps. In this embodiment the snout is 14.6 mm by 31.7 mm. The interference between the flaps and the printhead is as follows:

0 mm for flap 350 the front flap engaging face 180 of the printhead, 0.5 mm for the rear flap 340 engaging the interconnect face 150, 0.5 mm for the side flap 330 and 1.0 mm for the other side flap 370.

This last flap 370 protects the X datums and thus has a large interference so as to accomodate any movement of the printhead away from the datum due a paper crash. Since the printhead is forced towards the carriage datums by biasing means in the carriage any movement of the printhead would be away from the datum. The maximum possible displacement of the printhead is 0.6 mm in this case and adding the maximum positioning error due to tolerancing of 0.3 gives a total of 0.9 mm so an interference of 1.0 mm will ensure that the flap will always remain in contact and bent downwards.

In generally there should be sufficient interference to ensure that the flaps are deflected downwards towards the printing surface on entry of the printhead into the carriage so as to ensure a good seal around the printhead. However a futher consideration is that the printhead must be service in the normal manner in the service station and thus the level of downward deflection of the flaps should be controlled so that they do not extent so far that they interfer with servicing functions such as capping and the like.

An exeption to these guidelines has been found to be effective in the case of flap 350 (for the front face 180 of the printhead for which an interference of zero has been set. This is because the Y datum, 700 in FIG. 7, for this particular printhead and carriage protrudes away from the carriage stall into the opening 500 and thus if an interference was used for flap 350 it may occassionally get pinched between the printhead and carriage Y datums. The would affect the printhead location as well as causing wear to the flap. Despite the lack of interference it has been found in practise that the flap is very close to the printhead face 180 and that no significant ink aerosol has been seen in the carriage. Thus will be appreciated that interference or deflection of the flaps is not necessary in all cases.

As can be best seen from FIG. 9, the flap 340 for the interconnect face is attached to the baffle 430 section of the protector 400. Thus, since the baffle is angled away from the printhead ejection surface 60, the initial undeflected position of flap 340 is also angled with respect to this surface. in this embodiment this angle is 11 degrees.

As will be appreciated once the printhead is inserted into the carriage the flaps having interference with, and therefore being deflected by, the printhead will be at larger angle to the surface 60 at their ends proximate the printhead face. For the parameters given above these angles are as follows before and after printhead insertion:

from 11 degrees to 30 degrees for the rear flap 340 engaging the interconnect face 150, from zero degrees to 30 degrees for the side flap 330 from zero degrees to 40 degrees for the other side flap 370 due to large interference and remains zero for flap 350 the front flap engaging face 180 of the printhead since it has no interference.

The gap 390 in the flap 330 is provided if a snout wiper is employed in the printer in order to allow any dried ink accumulated on the side face of the printhead 190 due to wiping of the snout wiper across the interconnect face 150 to pass by the flap 330 when the printhead is removed from the carriage without contacting the flap so that the flap does not knock this ink off the printhead and onto the printing surface. Although potentially ink aerosol could pass through this small gap in practise this has not been seen to be a problem. Furthermore the gap is on the opposite side of the carriage stall from the X datums which is thus less sensitive to ink residue.

FIG. 10A shows an alternative embodiment in which only a single flap 340 for the interconnect face 150 is provided. The flaps 340 are glued at 820 directly onto a carriage flex circuit 810 which is then mounted on the carriage.

FIG. 10B shows the flex circuit in a carriage and the flap 340 acting on the interconnect face 150 of a printhead 50.

Figure 12:
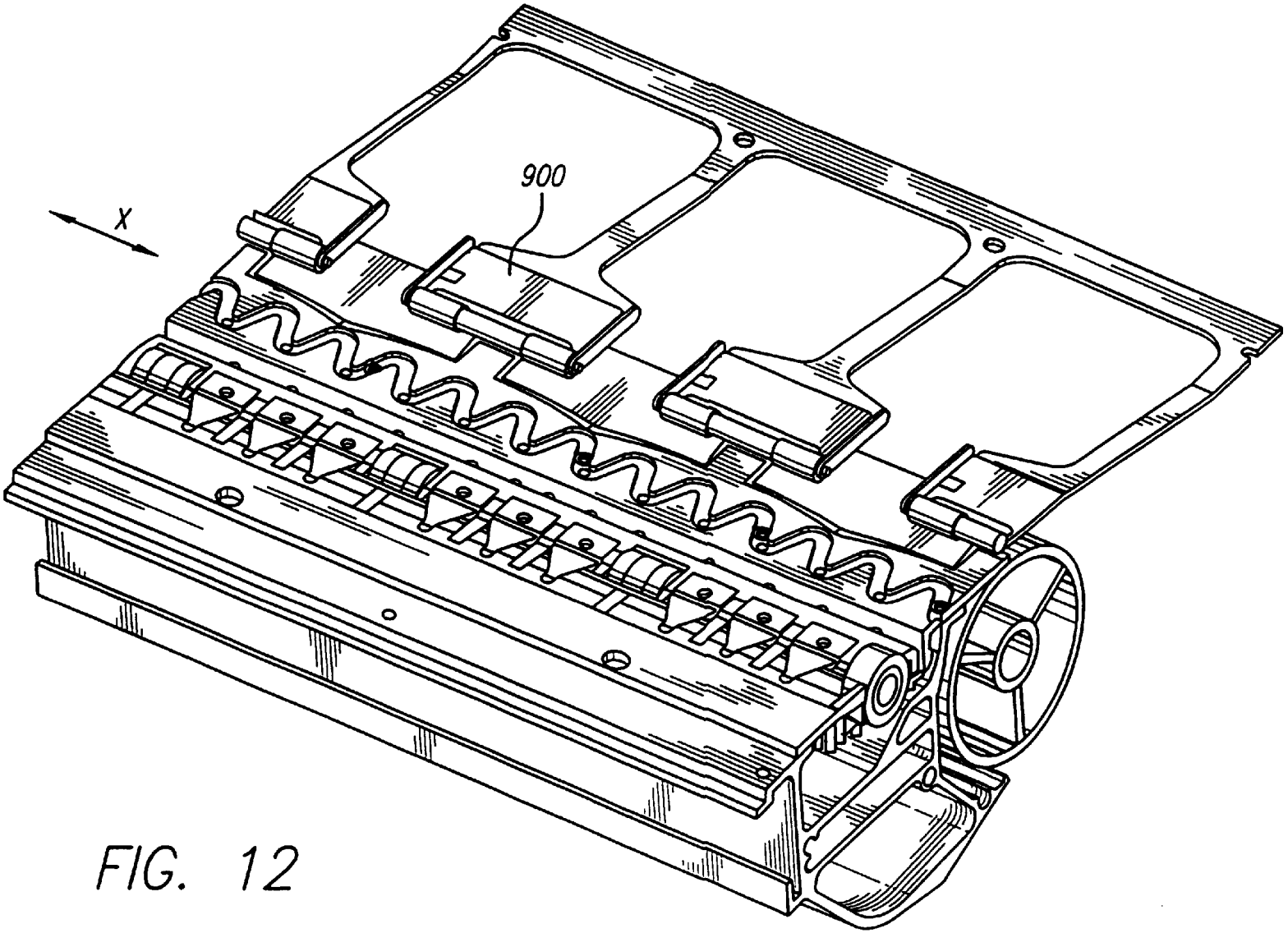

FIG. 11 shows a pinch wheel arrangement 900 of a media system of the printer in relation to the baffle 430 and deflector 440. As can be seen the gap 910 between the carriage and the pinch wheel arrangement is quite small. FIG. 12 shows a general view of the pinch wheel arrangement in the printer from which it can be seen that the pinch wheel extend in the carriage scan axis X. Since the pinch wheels are sprung so as to urge the paper or other print media downwards onto the printing surface, if a paper crash occurs the pinch wheel mechanism may be forced upwards where in may be hit by the carriage. Should this occur the deflectors 440 of the baffle 430 of the protector 400 should ensure that the carriage rides over the crumpled media rather than halting abruptly which could cause damage to the carriage drive mechanisms, the pinch wheel assembly or the flex circuit.

The prefered materials and thicknesses for the dam 380 and protector 400 have been given above. As will be appreciated these materia and the specified dimensions may be varied to a great extent with the scope of the present invention and those skilled in the art will, with the aid of the teaching provided herein be able to determine suitable parameters for numerous printhead and carriage designs.

The following general guidelines may also prove useful in aiding alternative materials choices.

The dam material should preferably have the following characteristics, so that it can keep an effective seal:

resistance to inks (pigment base and dye base)

resistance to the high temperatures the printhead can reach resistance to creep in storage condition (up to 70°C.)

resistance to repeated printhead insertion and removal through the product life flexibility so that it should never cause a noticeable effect on the printhead insertion, removal or reseating after a paper crash.

The dam protector material should preferably have the following characteristics:

resistance to inks (i.e: to water and acids)

mechanical resistance.

What is claimed is:

1. An ink protection device for an inkjet printhead mountable within a carriage of a printer the printhead having an ink ejection surface through which ink is ejected and a plurality of faces extending from the ink ejection surface, the device comprising:

a flap member associated with the printhead and extending generally parallel to the ink ejection surface so that when the printhead is mounted in the carriage the flap member extends between the carriage and a nonejecting face of the printhead.

2. A device according to claim 1, wherein one of said plurality of faces of the printhead is an interconnect face for electrical connection with the carriage, and said flap member is associated with said interconnect face so as to protect it from ink ejected by the printhead.

3. A device according to claim 1, wherein said flap member is formed of a resilient material and a first end of the flap member is attached to the carriage of the printer and a second end of the flap member is free to move.

4. A device according to claim 3, wherein upon installation of the printhead into a stall of the carriage, the printhead deflects the resilient flap member.

5. A device according to claim 4, wherein the printhead deflects the flap member by less than 45 degrees.

6. A device according to claim 5, wherein prior to said deflection of the flap member, the flap member extends at an angle of less than 30 degrees to the plane of the ejection surface of the printhead when mounted in the carriage.

7. A device according to claim 1, wherein said flap member is formed of a compliant material and wherein upon installation of the printhead into a stall of the carriage, the flap member engages a face of the printhead so as to substantially prevent ink from flowing past the flap member.

8. A device according to claim 7, comprising a plurality of flap members each associated with a different face of the printhead.

9. A device according to claim 8, wherein the device comprises four flap members associated with the printhead.

10. A device according to claim 7, wherein the amount of deflection caused by the installation of the printhead for two of said plurality of flap members is different.

11. A device according to claim 10, wherein the amount of deflection of a flap member associated with a printhead face having a positioning datum surface is greater than the amount of deflection of a flap member associated with a printhead face not having a positioning datum surface.

12. A device according to claim 7, said plurality of flap members are formed from a single substantially laminar sheet mounted to a lower part of the carriage.

13. A device according to claim 12, wherein the flap members surround an opening in a stall of the carriage through which the printhead ink ejection surface passes during installation in the carriage.

14. A device according to claim 13, wherein the flap member associated with the interconnect face of the printhead extends the full wide of said opening in the stall of the carriage and wherein the flap member(s) associated with neighboring faces of the printhead extend less than the whole width of the opening in the stall.

15. A device according to claim 14, wherein a flap member neighboring the interconnect face flap member, at an end of said flap member adjacent the interconnect face flap member, comprises a portion which does not extend far enough to engage the printhead.

16. A device according to claim 11, wherein said single substantially laminar sheet comprises a plurality of openings each having a plurality of flap members and wherein said openings are located to be in alignment with openings in stalls of the carriage through which printhead ink ejection surfaces pass during installation of printheads into the carriage.

17. A device according to claim 16, comprising a first substantially laminar component formed of a flexible material and a second substantially laminar component formed of stiffer material, the first component comprising a plurality of openings each having at least one flap member and the second component comprising a plurality of openings located to be in alignment with said openings in the first component and wherein both components are adapted to be mounted to a surface of the carriage of the printer which is close to a print zone of the printer so that the first component is supported by the second component.

18. A device according to claim 17, wherein said openings in said second components are larger than said openings in said first component and wherein the relative size of said openings is determined dependent on the flexibility of the first component and the desired contact force between the at least one flap member of the first component and a printhead.

19. A device according to claim 17, wherein said second component comprises a baffle member, for protecting components of the carriage from mechanical damage, located proximate to an interconnect flap member of said first component.

20. A device according to claim 19, wherein the baffle member extends away from the second component of the device at an angle to the plane of the second component.

21. A device according to claim 19, wherein the baffle member extends along a scanning axis of the carriage of the printer and comprises at its extreme ends in the scanning axis direction, a deflector angled further away from the plane of the second component of the device.

22. A device according to claim 21, wherein the carriage of the printer comprises an electrical connection member for establishing electrical connection to an interconnect face of a printhead and wherein said flap member is mounted on said electrical connection member of the carriage.

23. A device according to claim 1 or 2, wherein said flap member is mounted on a face of the printhead and engages the carriage when the printhead is installed into the carriage.

* * * * *